US010336481B2

(12) United States Patent
Jolley et al.

(10) Patent No.: US 10,336,481 B2
(45) Date of Patent: Jul. 2, 2019

(54) DISPLAY PACK

(71) Applicant: INNOVATIVE PACKAGING DESIGNS L.P., Montgomeryville, PA (US)

(72) Inventors: Carl Jeffrey Jolley, Plymouth Meeting, PA (US); Matthew Meehan, Philadelphia, PA (US)

(73) Assignee: MID-ATLANTIC PACKAGING SPECIALTIES, INC., Montgomeryville, PA (US)

( * ) Notice: Subject to any disclaimer, the term of this patent is extended or adjusted under 35 U.S.C. 154(b) by 0 days.

(21) Appl. No.: 15/592,574

(22) Filed: May 11, 2017

(65) Prior Publication Data

US 2017/0327267 A1 Nov. 16, 2017

Related U.S. Application Data

(60) Provisional application No. 62/334,602, filed on May 11, 2016.

(51) Int. Cl.

| | |
|---|---|
| ***B65D 5/32*** | (2006.01) |
| ***B65B 7/20*** | (2006.01) |
| ***B65D 5/54*** | (2006.01) |

(52) U.S. Cl.

CPC ..... *B65B 7/20* (2013.01); *B65D 5/321* (2013.01); *B65D 5/54* (2013.01)

(58) Field of Classification Search

CPC .. B65B 5/10; B65B 7/10; B65B 43/10; B65B 51/02; B65B 7/20; B65D 5/32; B65D 5/321; B65D 5/42; B65D 5/468; B65D 5/54; B65D 71/38; B65D 5/46

USPC ..... 206/736, 774

See application file for complete search history.

(56) References Cited

U.S. PATENT DOCUMENTS

| | | | | |
|---|---|---|---|---|
| 5,881,884 | A * | 3/1999 | Podosek | B65D 5/5445 206/736 |
| 6,435,351 | B1 * | 8/2002 | Gibb | B65D 5/542 206/736 |
| 7,798,391 | B2 * | 9/2010 | Tibbels | B65D 5/16 229/125.19 |
| 8,342,335 | B2 * | 1/2013 | Couture | B65D 5/5445 206/746 |
| 8,740,053 | B2 * | 6/2014 | Snyder | B65D 5/42 206/736 |
| 8,752,708 | B2 * | 6/2014 | Keefe | B65D 5/5445 206/736 |
| 9,096,343 | B2 * | 8/2015 | Jolley | B65D 5/36 |
| 9,359,103 | B2 * | 6/2016 | Waidelich | B65D 5/328 |
| 2016/0159513 | A1 * | 6/2016 | Frost | B65D 5/02 206/774 |

FOREIGN PATENT DOCUMENTS

| | | | | |
|---|---|---|---|---|
| FR | 2752816 A1 * | 3/1998 | | B65D 5/52 |

* cited by examiner

*Primary Examiner* — Bryon P Gehman

(74) *Attorney, Agent, or Firm* — Fox Rothschild LLP

(57) ABSTRACT

An improved display pack that can hold products during shipping and display products at the point of sale. The display pack is separable into a display section and a removable upper section. The removable upper section is removed to expose the product, allowing the packaged product to be displayed in the remaining display section. A joined in-the-flat blank unit that can be assembled into the display pack is also provided.

25 Claims, 14 Drawing Sheets

DISPLAY PACK

CROSS REFERENCE TO RELATED APPLICATION

This application claims the benefit of U.S. provisional patent application Ser. No. 62/334,602 filed on May 11, 2016, and which is incorporated herein by reference in its entirety.

BACKGROUND OF THE INVENTION

The invention relates to a packaging container for the reception and presentation of a group of articles, and more particularly to small display packs consisting of relatively rigid packaging material, such as corrugated paper board, for displaying retail items therein on a retail store shelf. The invention further relates to a process for producing and filling a packaging container of this type.

Current display packs serve multiple functions. One function is the containing of small retail packages, such as dried fruit, during transport and storage. Another is to serve as containers for displaying the small packages for sale to consumers. For the display function, the display packs are open on one side, namely at the top, allowing access to the contents within. A disadvantage of currently known display packs is the suitability for use with automated machinery capable of assembling, filling, and sealing the closed display pack. In many instances, known display packs are not suitable for use with the machinery used by the packers, who are forced to ship their products in a non-display pack style container to a co-packer who removes the items and repackages them in a display pack acceptable to the retailer. Accordingly, a display pack that is suitable with typical packaging machines used by packers is desired.

SUMMARY OF THE INVENTION

The present invention provides an improved display pack that can be used, for example, to hold packaged products during shipping, and during display of the products at the point of sale. In one form, and in broad terms, the present invention provides a display pack separable into a display section and a removable upper section. The display pack includes a bottom panel, and at least one pair of inner side wall panels for forming at least a portion of the display pack side walls. The inner side wall panels are disposed on opposite sides of the display pack. The display pack also has a rear panel adjoining the bottom panel, a top panel adjoining the rear panel, and an inner front panel adjoining the top panel. The display pack further includes an outer front panel adhered to the inner front panel, and a pair of outer side wall panels adjoining opposing sides of the outer front panel. Each of the outer side wall panels is secured to an outer face of a respective one of the inner side wall panels.

In one possible embodiment of the display pack, the removable section is made up of the top panel, the inner front panel, a portion of the outer front panel, and a portion of each of the outer side wall panels. The removable section can be removed to expose the packaged product, allowing the packaged product to be displayed in the remaining display section of the display pack.

The present invention also provides a joined in the flat blank unit for producing a display pack. In one form, the joined blank unit includes first and second blanks which include the various panels for forming the display pack. The first blank includes the inner front panel. The second blank includes the outer front panel. To form the flat blank unit, the outer front panel is secured to the inner front panel forming the combined in-the-flat blank.

The present invention also provides a display section of a display pack. The display section can be used, for example, to hold packaged products during display of the products at the point of sale. In one form, and in broad terms, the display section includes a bottom panel for forming at least a portion of a display pack bottom, and at least one pair of inner side wall panels for forming at least a portion of the display pack side walls. The inner side wall panels are disposed on opposite sides of the display pack. The display section also has a back panel forming at least a portion of a display pack back wall.

The display section also a front panel forming at least a portion of a display pack front wall, and a pair of outer side wall panels for forming at least a portion of the display pack side walls. Each of the outer side wall panels is integrally attached to and extends from opposite side edges of the front panel to form outer side walls. Each of the outer side wall panels is adhered to an outer face of a respective one of the inner side wall panels.

BRIEF DESCRIPTION OF THE DRAWINGS

The foregoing summary and the following detailed description may be better understood when read in conjunction with the accompanying drawings. For the purpose of illustrating the invention, a preferred embodiment is shown in the drawings. It is understood, however, that this invention is not limited to the precise arrangements shown.

DESCRIPTION OF A PREFERRED EMBODIMENT

Figure 1:
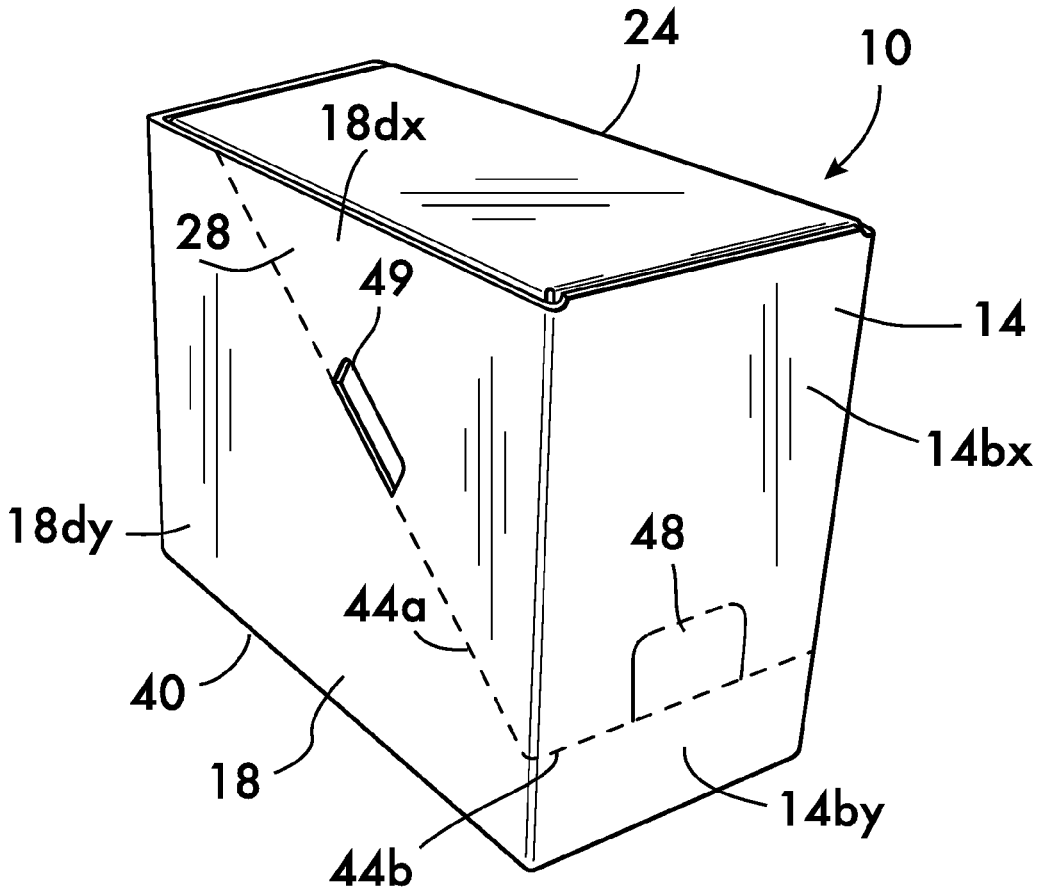
FIG. 1 is a perspective view of an unopened display pack in accordance with the present invention, resting on its bottom panel.
Figure 2:
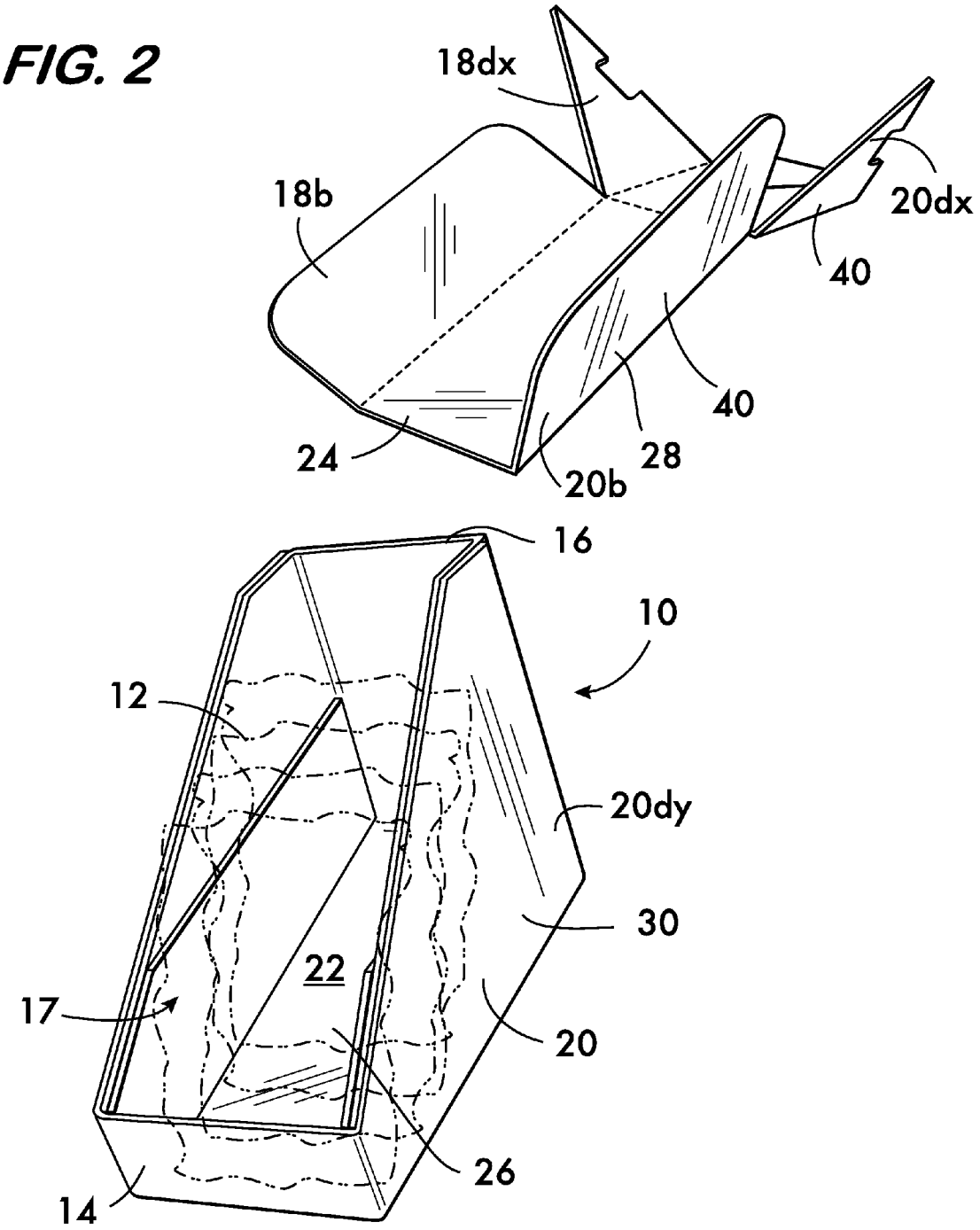
FIG. 2 is a perspective view of the display pack of FIG. 1, with a top section of the display pack removed to facilitate display of the contents within.

With initial reference to FIGS. 1 and 2, a display pack 10 is shown containing a product such as stacked packages of dried fruit 12 shown in broken line (FIG. 2). The display pack 10, when configured as depicted in FIG. 1, can be used to ship the products 12 to a retailer. The retailer can then open the display pack 10 to display and provide access to the products 12 within through a display opening 17 shown in FIG. 2.

Figure 15:
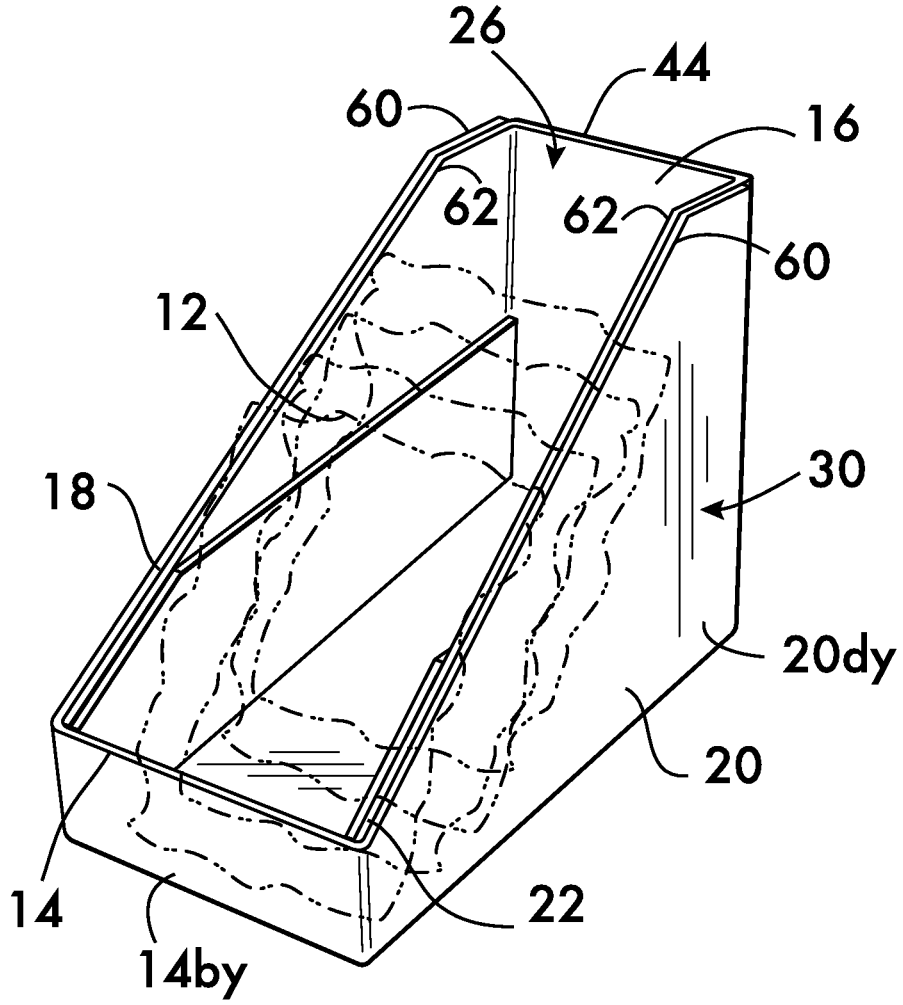
FIG. 15 depicts a display section of the display pack of FIGS. 1 and 2 sitting on its bottom panel, after the display pack has been opened and an upper removable section has been separated from the display section.

As depicted in FIG. 1, the display pack 10 in one form provides a closed container in which the products 12 can be shipped to the retailer. The display pack 10 has front wall 14, back wall 16, opposing side walls 18, 20 extending about a bottom section 22, and a top section 24 all defining an internal space 26 in which the retail products 12 are received, as shown in FIGS. 1, 2, and 15.

The display pack 10 can be opened to display the contents within. For example, after shipment to a retailer, the display pack 10 can be opened by separating an upper removable section 28 from a lower display section 30 containing the contents 12, and which display section 30 can be placed on a retail shelf where it can be accessed by customers. As further discussed below, the outside walls of the display pack 10, particularly the display section 30, can be made of a material suitable for printing to show branding or other desirable information and art work.

Figure 3:
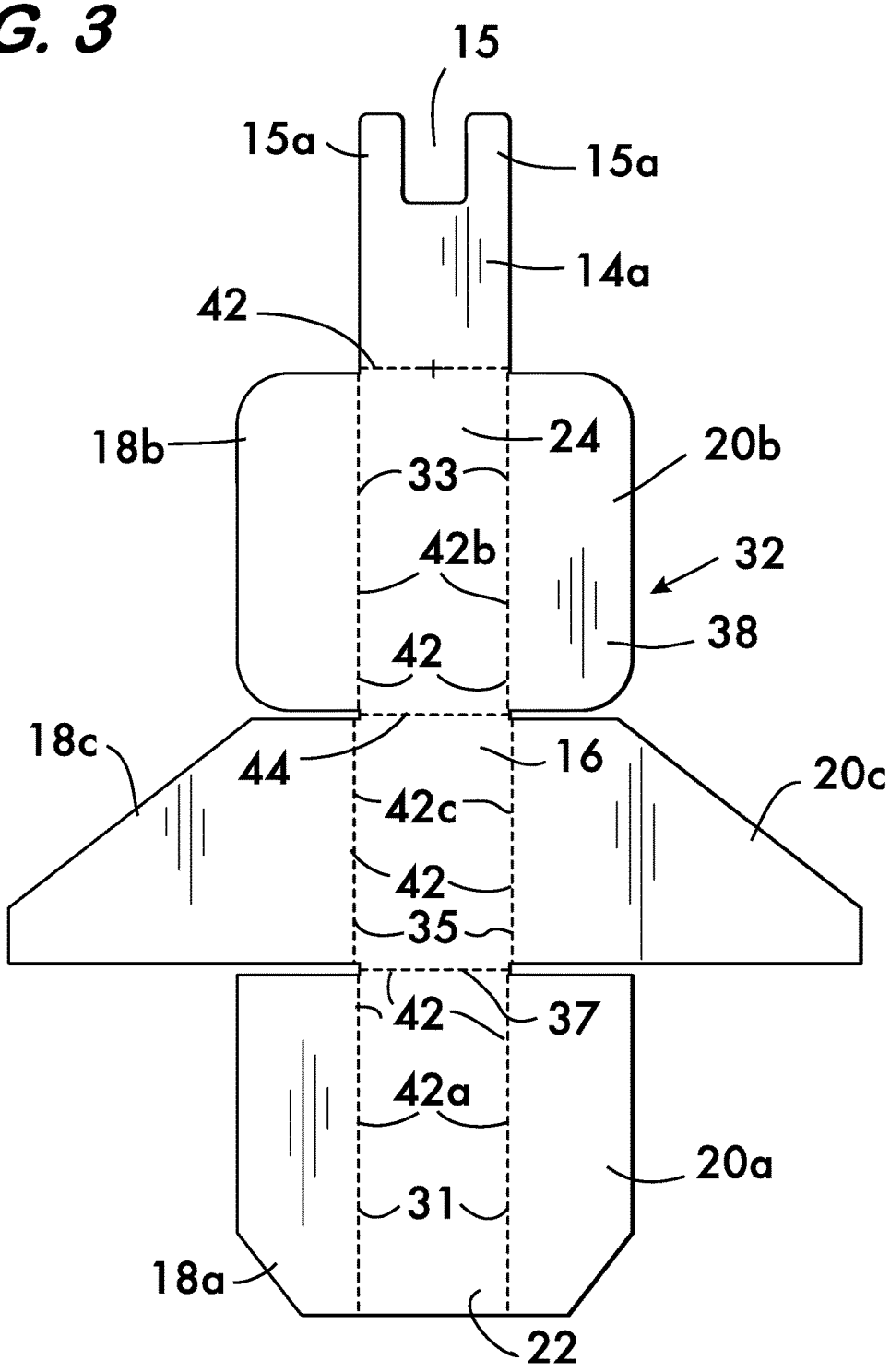
FIG. 3 is a plan view of a first blank for forming a body section of the display pack of FIGS. 1 and 2.
Figure 4:
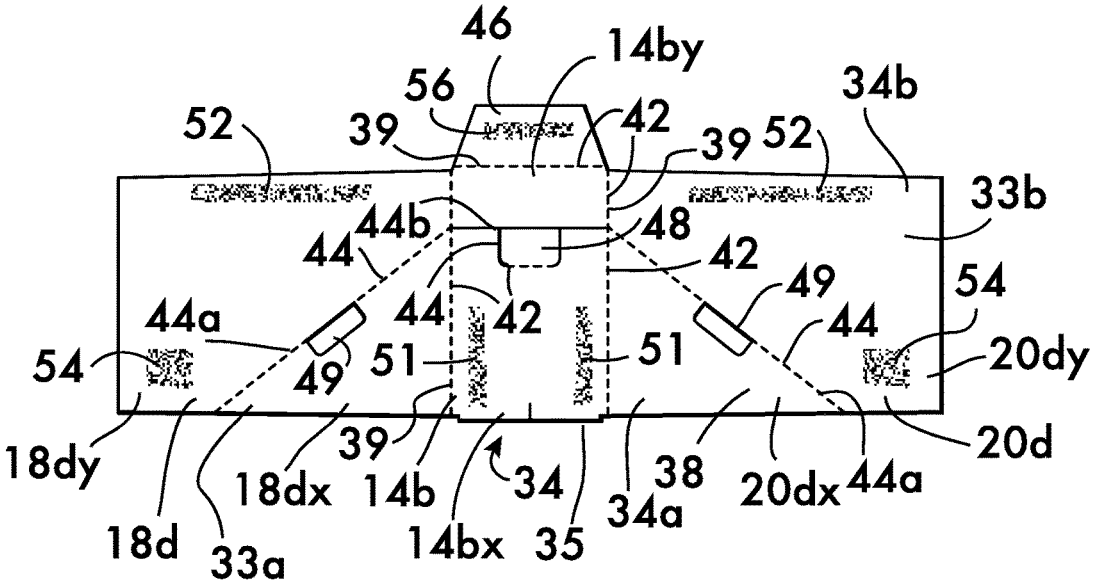
FIG. 4 is a plan view of a second blank for forming a branding section of the display pack of FIGS. 1 and 2.

Referring to FIGS. 3 and 4, blanks 32 and 34 for making the display pack 10 are now described. As will be described below, the blanks 32, 34 are combined to form a joined in-the-flat blank unit 36, shown in FIG. 5, which is shipped to the packer and can be assembled to form the display pack 10 shown in FIG. 1.

The blank 32, or body section blank, is preferably die cut from a unitary sheet of corrugated paperboard chosen for strength and the particular use desired. Since the individual panels of the blank 32 will not be positioned on the outside of the final display pack 10 visible to a consumer, a printable surface is not necessary. The blank 32 is oriented in FIG. 3 to show the inner face 38 of the blank 32 with the outer face 40 (FIG. 8) unseen on the underside of the blank.

The blank 32 includes as an integral unit the bottom panel 22 which forms at least a portion of the display bottom section, and includes rear or back panel 16 adjoining an edge 37 of the bottom panel 22, top panel 24, inner front panel 14*a*, opposing lower inner side panels 18*a*, 20*a* adjoining opposing side edges 31 of the bottom panel 22, opposing upper inner side panels 18*b*, 20*b* adjoining opposing side edges 33 of the top panel 24, and opposing full inner side panels 18*c*, 20*c* adjoining opposing side edges 35 of the rear panel 16. Fold lines 42 separate the various panels from one another along their shared edges as shown, with the exception of rear panel 16 and top panel 24 which are separated from one another by a separation fold line 44, such as a one formed with perforations, to allow the rear panel 16 and the top panel 24 to be folded and later separated from one another as described below. It is seen that the illustrated embodiment has three pairs of inner side panels which, in no particular order, include the first pair of inner side panels 18*a*, 20*a*, second pair of inner side panels 18*b*, 20*b*, and third pair of inner side panels 18*c*, 20*c*.

Figure 5:
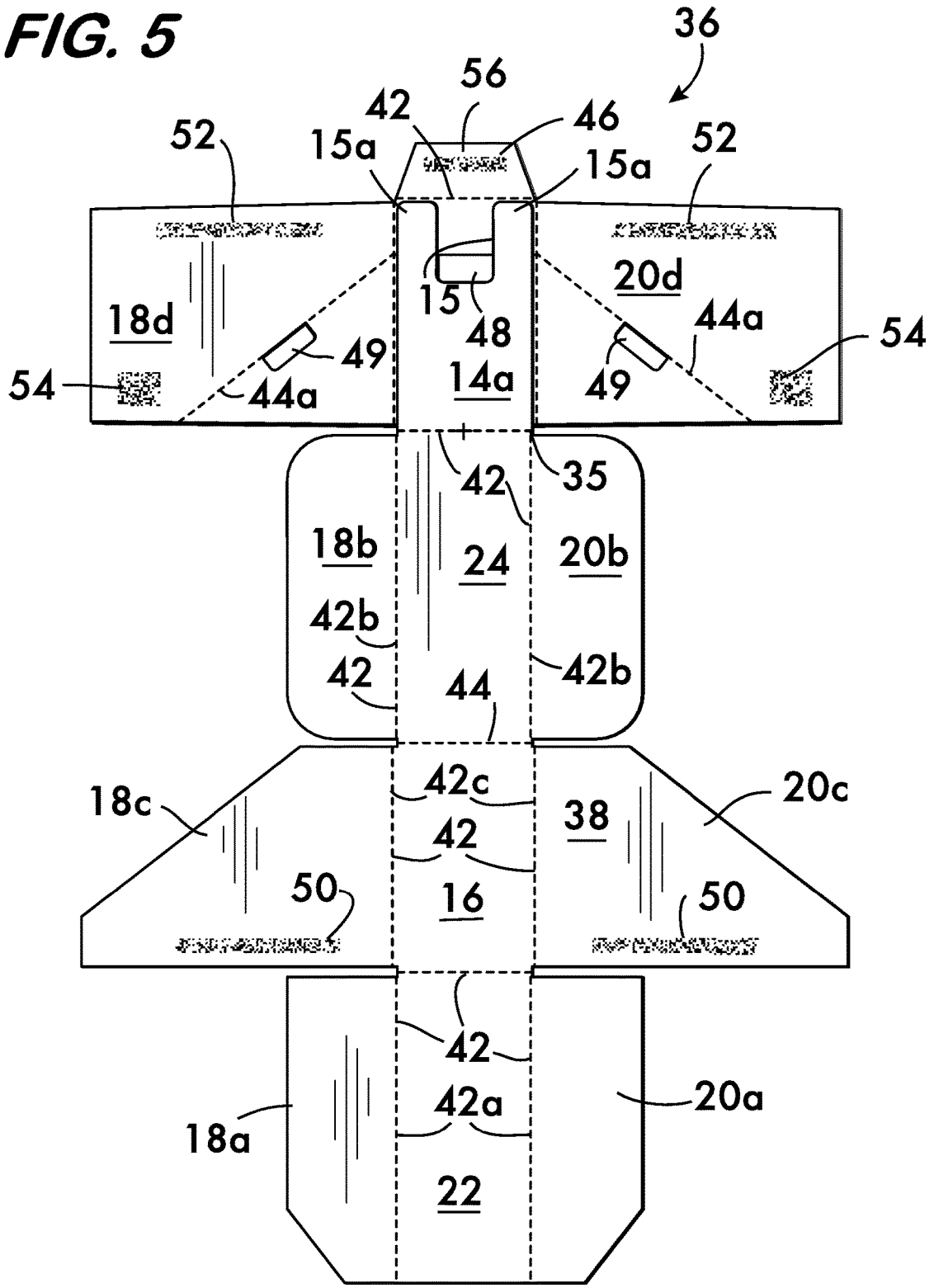
FIG. 5 is a plan view of the combined blanks of FIGS. 3 and 4 forming a joined in-the-flat blank unit which can be stacked and shipped to the packer.
Figure 6:
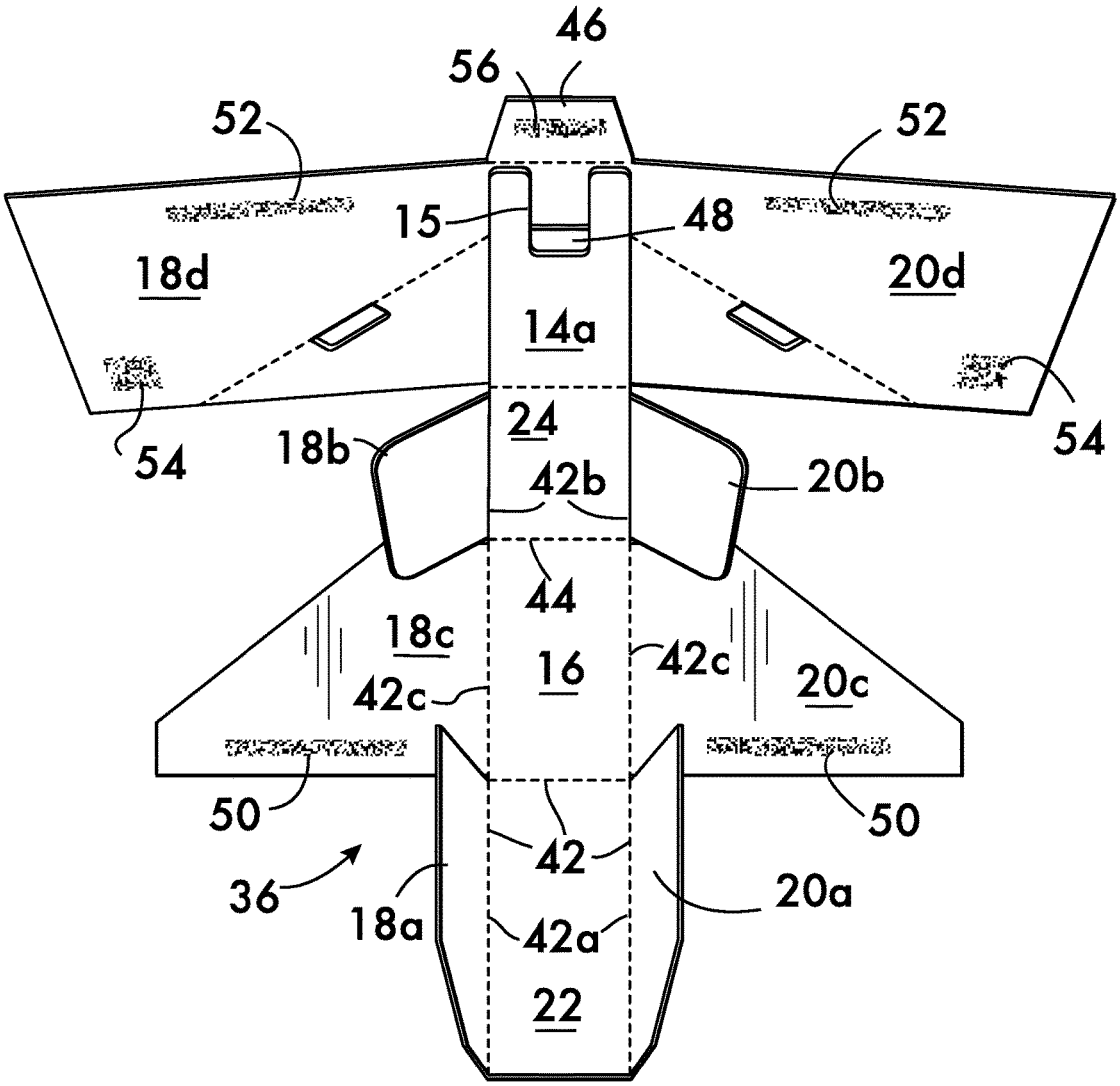
FIGS. 6 through 8 show the joined blank depicted in FIG. 5 being folded to begin forming the display pack of FIGS. 1 and 2, with the pre-formed display pack as depicted in FIG. 8 shown sitting on its rear panel ready to be filled with product.
Figure 8:
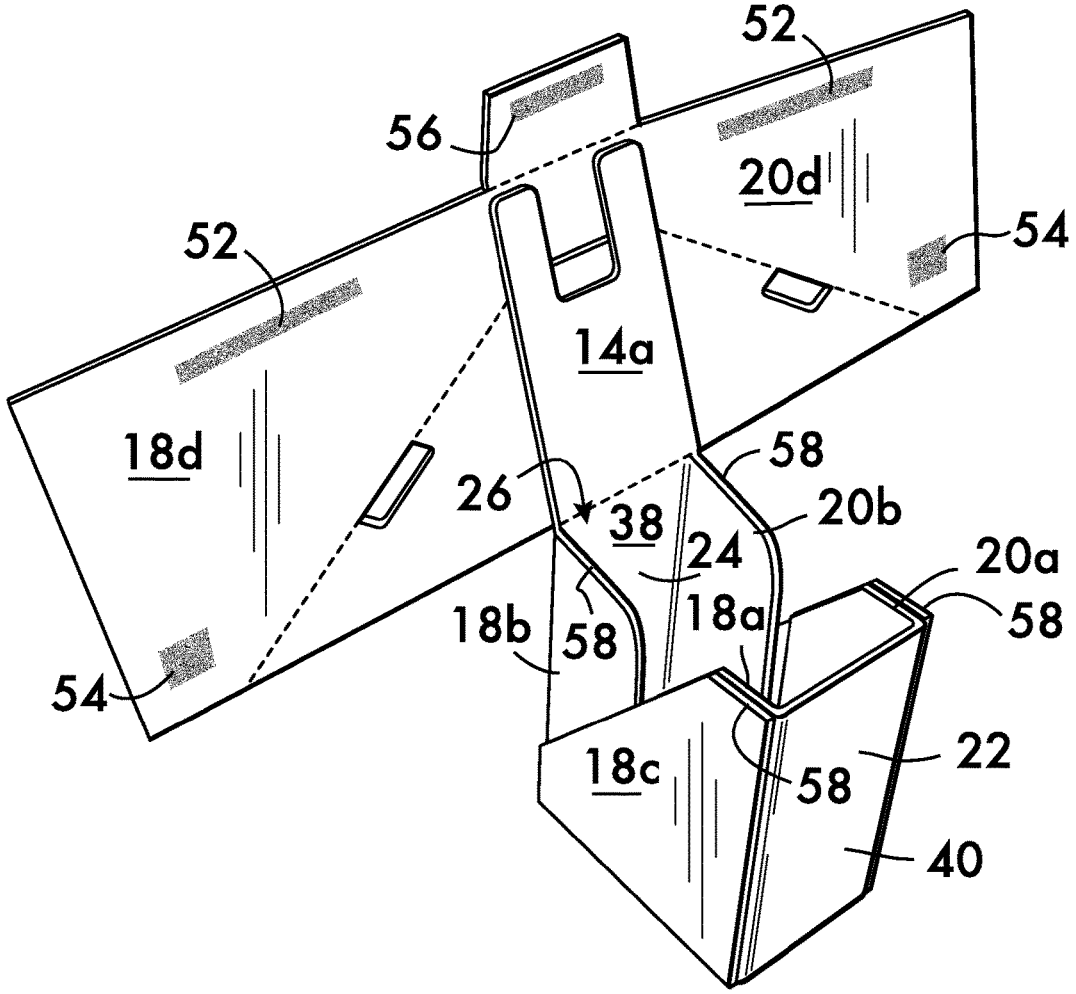
Figure 9:
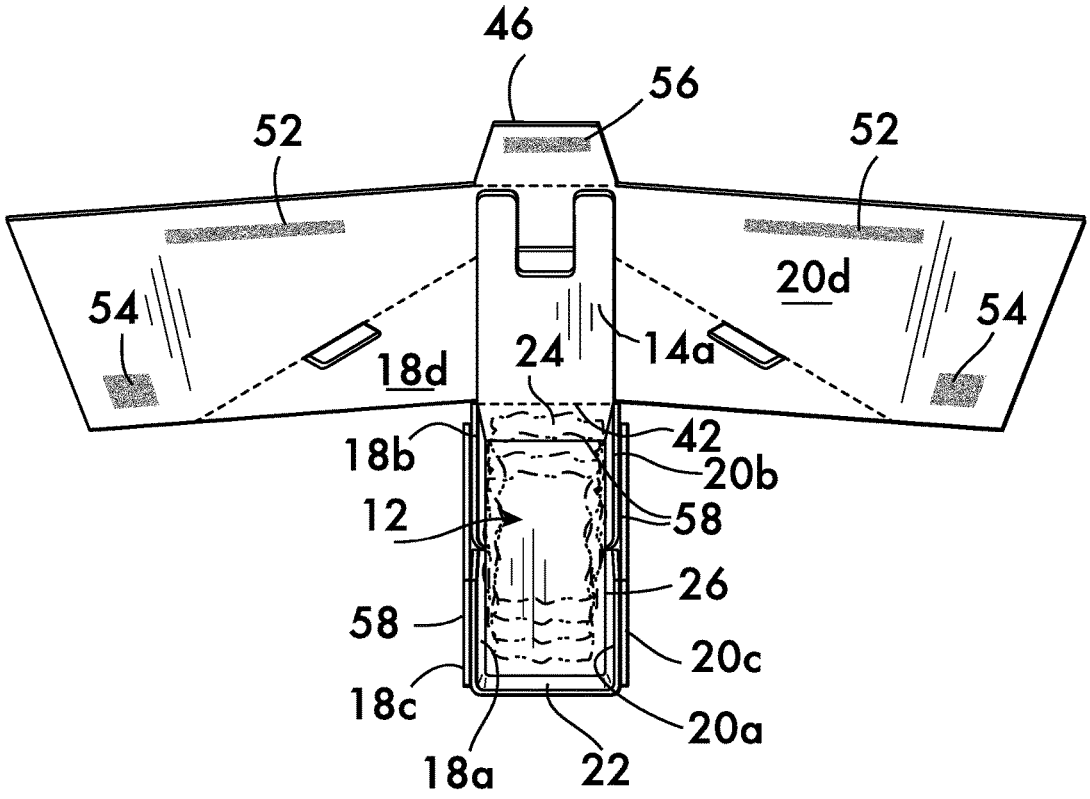
FIG. 9 shows the pre-formed display pack of FIG. 8 after being filled with product, and being further folded to form the display pack of FIGS. 1 and 2.

With further reference to FIGS. 5 and 6 in addition to FIG. 3, the specific fold lines 42*a* and 42*b* of lower and upper side panels 18*a* and 18*b* align so that the panels 18*a*, 18*b* will be approximately in the same plane when folded. The same applies for lower and upper side panels 20*a* and 20*b* whereby the specific fold lines 42*a* and 42*b* align so that the panels 20*a* and 20*b* will be in approximately same plane when folded. The specific fold lines 42*c* between the rear panel 16 and full inner side panels 18*c*, 20*c* are offset from the fold lines 42*a* and 42*b* to be greater in width (spacing) as shown, so that the full inner side panels 18*c*, 20*c* will be outside and adjacent to the respective lower and upper side panels 18*a*, 18*b* and 20*a*, 20*b* when folded, as seen in FIGS. 8 and 9.

The inner front panel 14*a* has a cutout 15, which aligns with a finger tab 48 in the blank 34 as shown in FIG. 5 and further described below. The two extension sections 15*a* on either side of the cutout 15 provide additional strength to the display pack 10.

The blank 34, also referred to as the outer or branding blank section, is now described with reference to FIG. 4. The blank 34 will form the wall panels of the display pack 10 that will be visible to the consumer. It is preferably die cut from a unitary sheet of corrugated paperboard having an outer face 40 (FIG. 2) suitable for printing, such as white face paper, for the branding information and artwork. The blank 34 is oriented in FIG. 4 to show the inner face 38 of the blank 34, with the outer face 40 unseen on the underside of the blank.

As shown in FIG. 4, the blank 34 includes as an integral unit the outer front panel 14*b*, opposing outer side panels 18*d*, 20*d*, and glue tab 46. Fold lines 42 separate the various panels along their shared edges 39 from one another as shown. Separation lines 44, formed for example by tear away perforated sections 44*a* and cut line 44*b*, divide the outer front panel 14*b* and the two outer side panels 18*d*, 20*d* into two sections, a removable section 33*a* and a remainder section 33*b* (FIG. 14), capable of being separated from one another as further described below. It is seen that separation of the two sections 33*a* and 33*b* would divide the outer front panel 14*b* into an upper section 14*bx* and a lower section 14*by*, and also divide each of the outer side panels 18*d*, 20*d* into an upper section 18*dx*, 20*dx* and a lower section 18*dy*, 20*dy*. As seen, a finger push in tab 48 formed by fold line 42 and cut lines 44*b* is provided for ease of removing the removable upper section 28 as discussed below. Optional finger cut outs 49 also are provided for ease of removing upper section 28.

The two blanks 32 and 34 are attached to one another to form the joined flat blank unit 36 shown in FIG. 5. The two blanks are secured together in any suitable manner, preferably by adhesive bonding, such as a hot or cold set glue applied in two lines 51 to the inside face 38 of the outer panel 14*b* (blank 34) as shown in FIG. 4, with the outer face 40 of the inner front panel 14*a* placed thereon to secure the two blanks 32, 34 together as shown in FIG. 5. The two blanks are aligned such that the lower edge 35 of the outer front panel 14*b* (FIG. 4) aligns approximately with the fold line 42 that divides the inner front panel 14*a* and the top panel 24 (FIG. 5). In addition, the push tab 48 aligns over the cutout 15, as shown in FIG. 5.

Completed in-the-flat joined blank units 36 can be stacked and shipped to the packer who then assembles and fills the display packs 10 with product for shipment to the retailer. The assembly and fill process is now described.

With initial reference to FIGS. 6 through 11, the joined blank 36 can be assembled into the display pack 10 by hand, or by automated set up machinery such as a tray former which can carry out the steps now described. With the inner face 38 of the in the flat blank unit 36 facing upward as shown, the rear panel 16 is held down, or pushed via a mandrel into a tray former mold if done using a machine, while the bottom panel 22 and top panel 24 are folded upwardly with respect to the rear panel 16 about respective fold lines 42, 44 as shown. It is seen that inner front panel 14*a* and the various panels connected thereto move with it as a unit. Lower inner side panels 18*a*, 20*a* and upper inner side panels 18*b*, 20*b* can be folded inwardly in respect to bottom panel 22 and top panel 24 respectively as shown at about the same time as can be performed by machinery. This leads to the configuration shown in FIG. 7 with the partially assembled display pack standing on its rear panel 16.

Figure 7:
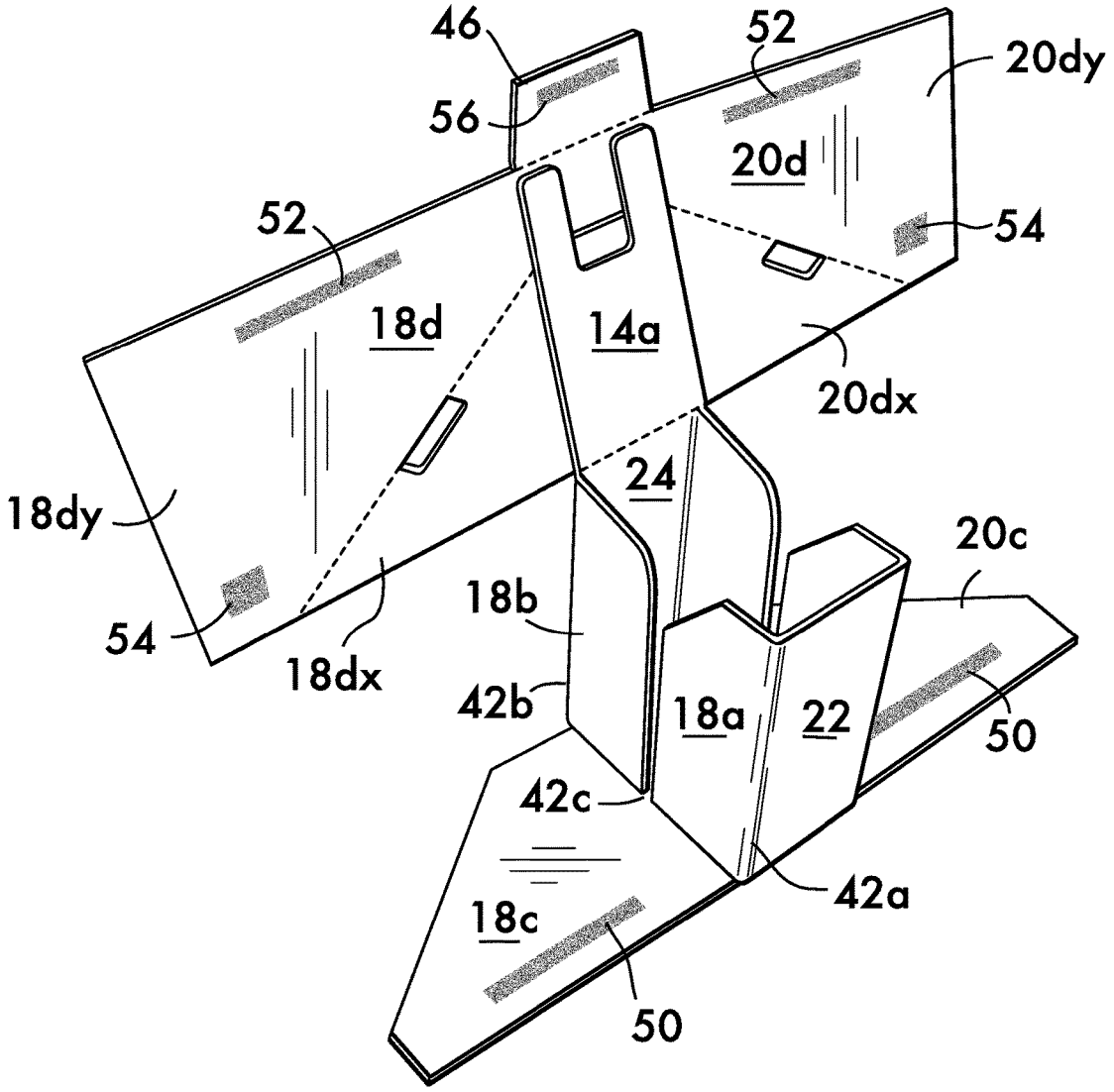

Adhesive, such as hot or cold set glue, is applied (at any suitable time) to the inner side panels 18*c*, 20*c* along a glue line 50 as seen in FIGS. 5 through 7, and the full inner side panels 18*c*, 20*c* are folded upwardly relative to the rear panel 16 around fold line 42*c* as seen in FIGS. 7 and 8. It is appreciated that the inner side panels 18*c*, 20*c* adhere to respective lower inner side panels 18*a*, 20*a* and not to the upper inner side panels 18*b*, 20*b*.

With further reference to FIG. 9, the assembly of the display pack 10 is now ready to receive product 12. While sitting on its rear panel 16 as shown, an ideal position to receive product packets 12 of the type shown in FIG. 9, the product packets 12 can be dropped into the internal space 26 and stacked although other product configurations and product fill processes can be used.

Figure 10:
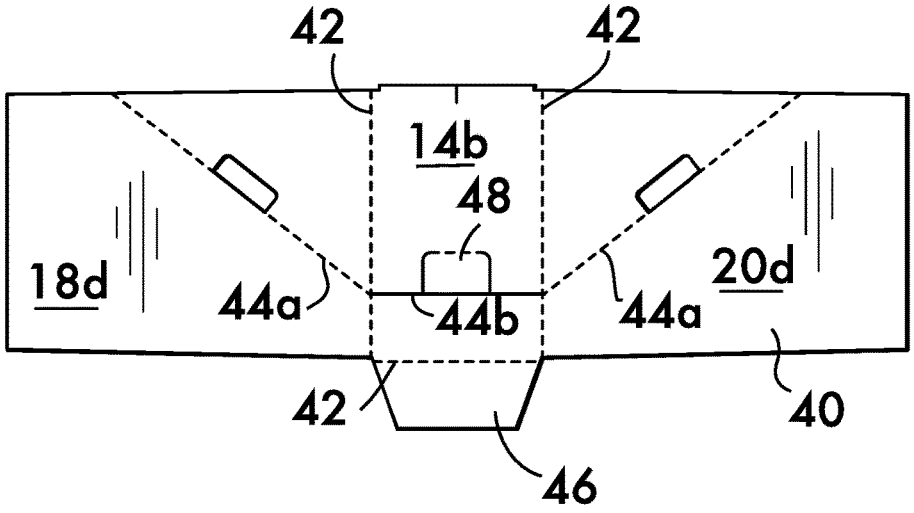
FIGS. 10 and 11 show the loaded, pre-formed display pack of FIG. 9 being further folded to form the display pack of FIGS. 1 and 2.
Figure 11:
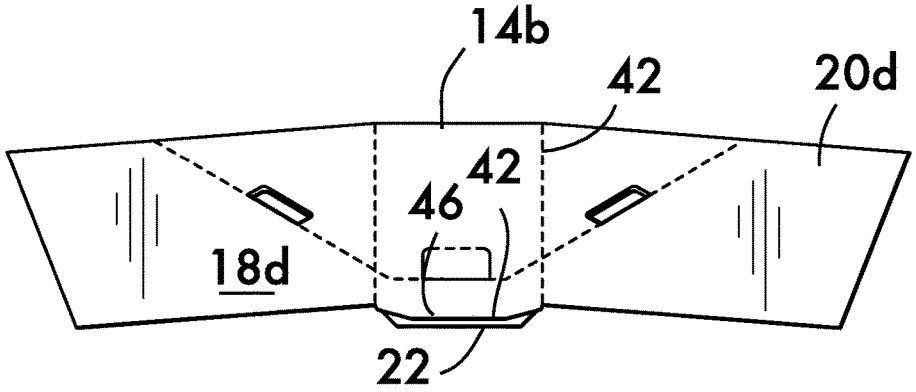

Once filled with product 12, the display pack 10 is ready to be sealed closed. For this final step, adhesive, such as hot or cold set glue, is applied via glue lines 52 and glue dots 54 to the outer side panels 18*d*, 20*d*, and via glue line 56 to the glue tab 46 (FIG. 9). With reference to FIGS. 9, 10 and 11 (FIGS. 10 and 11 are views looking downward onto outer face 40 of the front panel wall 14*b*), the front wall 14 (here front wall 14 including individual panels 14*a* and 14*b*) is folded with respect to top panel 24 along fold line 42 onto or adjacent the edges 58 of the side panels 18*a*, 18*b* and 18*c* and side panels 20*a*, 20*b* and 20*c*, as seen in FIG. 11.

Figure 12:
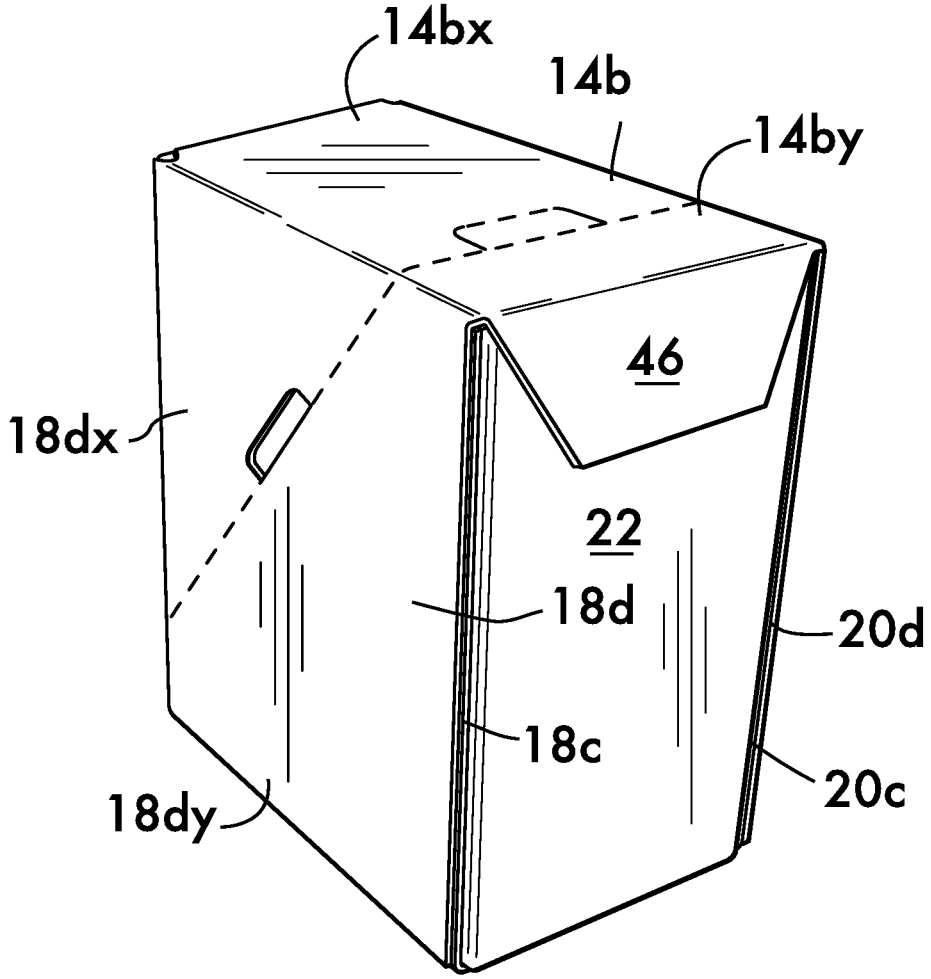
FIGS. 12 and 13 are perspective views of the display pack of FIGS. 1 and 2, in a fully-formed, closed condition and sitting on its rear panel.
Figure 13:
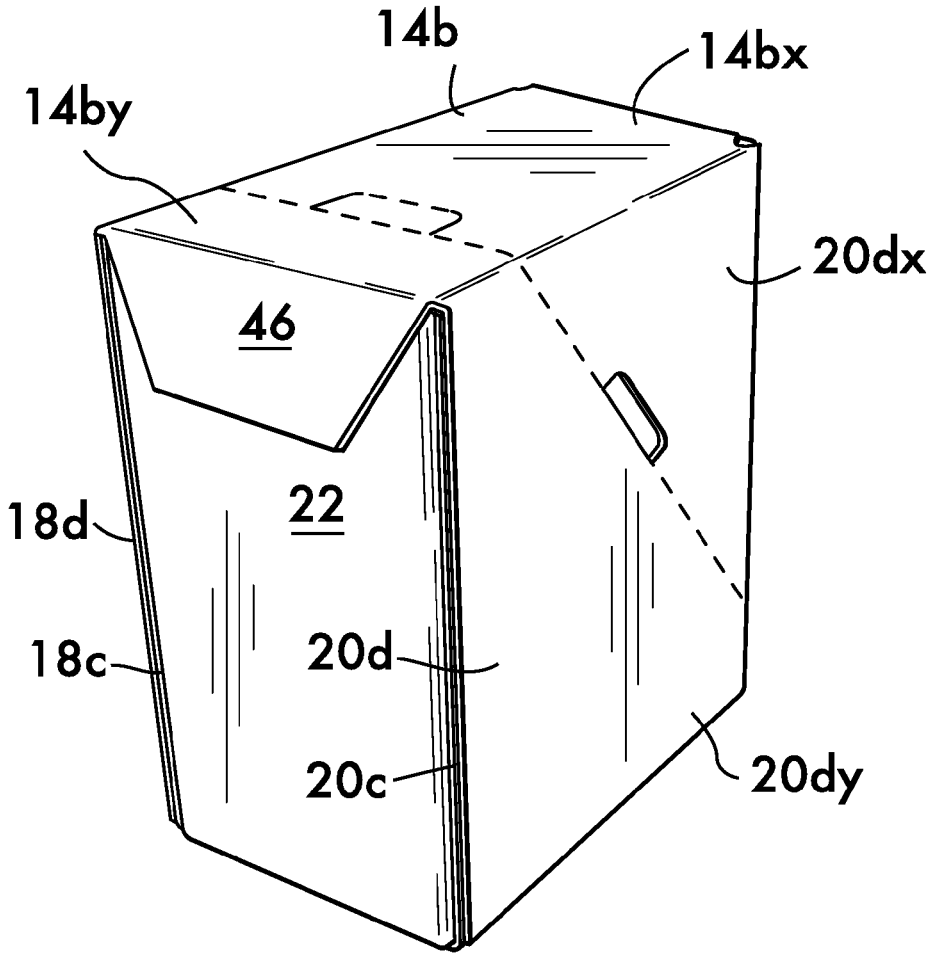

With further reference to FIGS. 11 through 13, the glue tab 46 is adhesively attached to the outer face 40 of the bottom panel 22 by folding relative to front outer panel 14*b* along fold line 42. The outer side panels 18*d*, 20*d* are folded with respect to outer front panel 14*b* around fold lines 42 and adhesively attached to the inner side panels 18*c*, 20*c*, thereby forming the assembled display pack 10 as shown in FIGS. 12 and 13 (sitting on its rear panel 16), or FIG. 1 (sitting on its bottom panel 22). It is seen that some of walls of the illustrated display pack 10 have multiple layers of panels, while others have only one.

With the product 12 stored within, display packs 10 can be stacked and shipped to the retailer, who opens the display pack 10 as now described.

Figure 14:
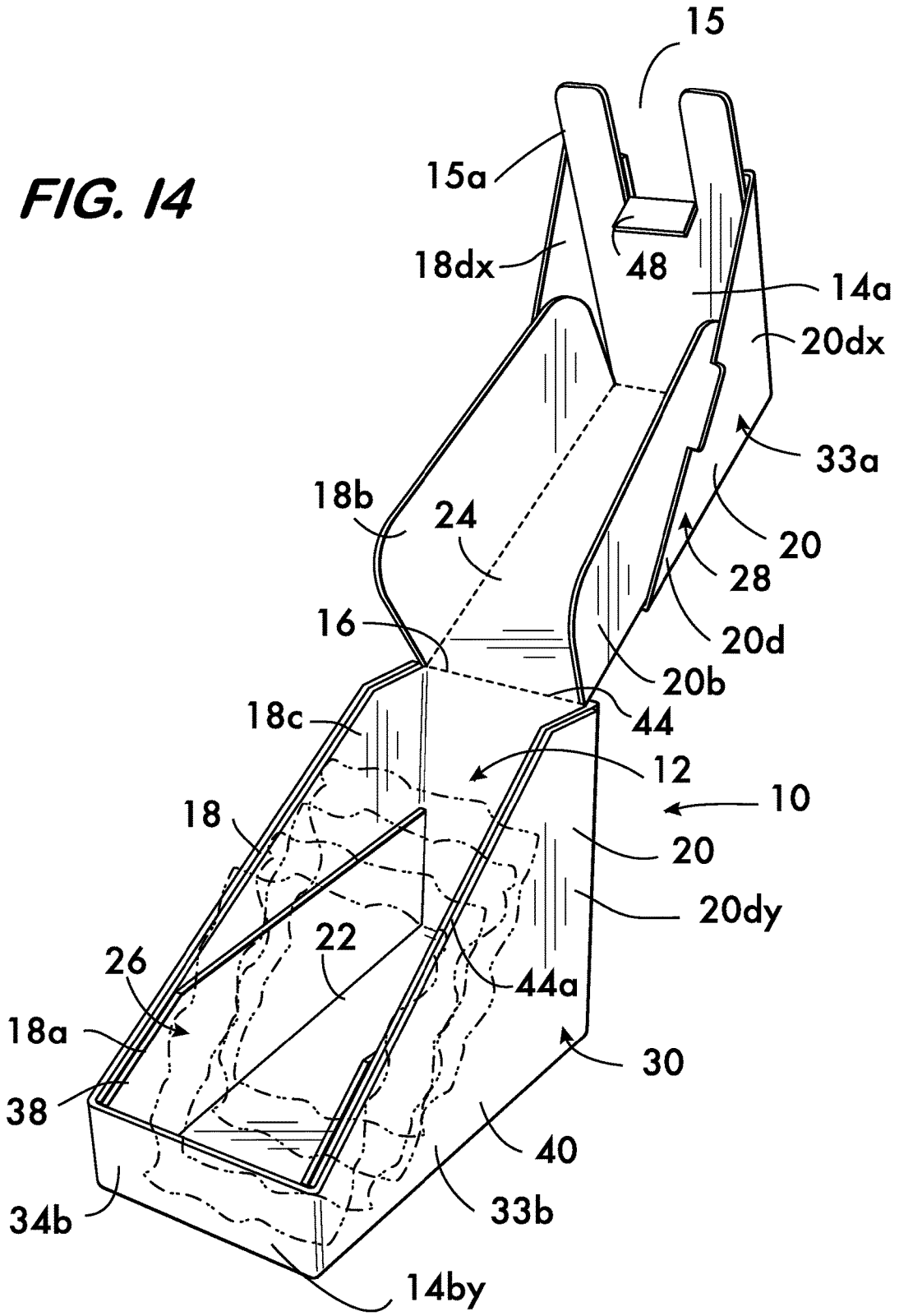
FIG. 14 depicts the display pack of FIGS. 1 and 2 sitting on its bottom panel, and being opened.

With reference to FIGS. 1, 14, and 15 the display pack 10 can be opened to display the contents 12 within. The user uses a finger to push in the tab 48 and pull upwardly the removable section 28 from the display section 30. This action causes the upper removable section 28 to rotate about the separation/fold line 44 between the rear panel 16 and top panel 24, separating the outer front upper panel section 14*bx* from the outer front lower panel section 14*by* at cut line 44*b*, and separating the outer upper side panels 18*dx*, 20*dx* from the outer lower side panels 18*dy*, 20*dy* along tear or separation line 44*a* as seen in FIGS. 1, 2, and 14. The removable section 28 is then separated at the tear fold line 44 between the rear panel 16 and top panel 24 and can be discarded as seen in FIG. 2.

The lower display section 30 with the product packets 12 now provides a display pack as seen in FIG. 2, which can be placed on a retail shelf where customers can access it. As can be seen in FIGS. 2, 14, and 15, the display section 30 includes the bottom panel 22, front panel 14 formed of panel 14*by*, opposing side walls 18 and 20 formed of panels 18*a*, 18*c*, 18*dy* and 20*a*, 20*c*, 20*dy*, and rear panel 16. The removable section 28 includes top panel 24, side panels 18*b*, 18*dx* and 20*b*, 20*dx*, and front panels 14*a* and 14*bx* (See FIGS. 12 and 13). It is seen that the branding blank 34, a smaller section of the overall display pack 10, provides the outer front panel 14*by* and outer side panels 18*dy*, 20*dy* of the display section 28 that will be seen by the consumers, thereby minimizing the amount of finished corrugated paperboard for the printed artwork.

It is further seen in FIG. 15 that the display opening 17 is defined by the upper edge of the outer front panel 14*by*, the horizontal and tapered upper edges 60 of the outer side panels 18*dy*, 20*dy* and horizontal and tapered upper edges 62 of the inner side panels 18*c*, 20*c*, and the upper edge of the back panel 16. This display opening 17 allows customers to see into and remove products 12 within.

These and other advantages of the present invention will be apparent to those skilled in the art from the foregoing specification. Accordingly, it will be recognized by those skilled in the art that changes or modifications may be made to the above-described embodiment without departing from the broad inventive concepts of the invention. It should therefore be understood that this invention is not limited to the particular embodiment described herein, but is intended to include all changes and modifications that are within the scope and spirit of the invention. For example, the above embodiments use various terms of orientation that are arbitrary such as rear and front and upper and lower in relation to the various panels. It is appreciated that what such terms are interchangeable without deviating from the spirit of the invention. Any suitable fold lines may be used, such as creases and perforations. Likewise, any suitable separation and tear lines can be used such as perforations and cuts. Any suitable adhesive or glue may be used and in any suitable configuration. Finally, it is appreciated that the various panels can take on different configurations and shapes, and some eliminated, without departing from the inventive concepts of the invention.

What is claimed is:

1. A display pack separable into a display section and a removable upper section, comprising:

a bottom panel;

at least one pair of inner side wall panels for forming at least portions of side walls of the display pack, said at least one pair of inner side wall panels disposed on opposite sides of said display pack;

a rear panel adjoining a back edge of the bottom panel;

a top panel adjoining a top edge of the rear panel;

an inner front panel adjoining a forward edge of said top panel, wherein said bottom panel, said at least one pair of inner side wall panels, said rear panel, said top panel and said inner front panel are formed as an integral unit from a first unitary sheet of material;

an outer front panel secured to the inner front panel, and a pair of outer side wall panels adjoining opposing side edges of the outer front panel, each of said outer side wall panels being secured to an outer face of a respective one of said at least one pair of inner side wall panels, wherein said outer front panel and said pair of outer side wall panels are formed as an integral unit from a second unitary sheet of material.

2. The display pack of claim 1 wherein said at least one pair of inner side wall panels comprises first and second pairs of inner side wall panels, said first pair of inner side wall panels adjoining opposing side edges of said bottom panel, and said second pair of inner side wall panels adjoining opposing side edges of said rear panel.

3. The display pack of claim 2, further comprising a third pair of inner side wall panels adjoining opposing side edges of the top section.

4. The display pack of claim 3, wherein a first panel of said first inner pair of inner side wall panels extends in a substantially same plane as a first panel of said third inner pair of inner side wall panels, and wherein said third inner pair of inner side wall panels is disposed above said first inner pair of inner side wall panels.

5. The display pack of claim 1, wherein: the outer front panel comprises an exterior front surface of the display pack; the pair of outer side wall panels each comprise an exterior side surface of the display pack; and the exterior front surface and the exterior side surfaces are configured to receive printing thereon.

6. The display pack of claim 1, wherein:

the outer front panel has a first portion and a second portion separable from one another along a separation line; and each of said pair of outer side wall panels has a first portion and a second portion separable from one another along a second separation line.

7. The display pack of claim 6, wherein the first portion of the outer front panel is secured to the inner front panel; and each of the second portions of said outer side wall panels are secured to one of the at least one pair of inner side wall panels.

8. The display pack of claim 6, wherein:

the top panel and the rear panel are configured so that the top panel is separable from the rear panel; and the display pack has a removable upper section that includes the top panel, the inner front panel, the first portion of the outer front panel, and the first portions of the outer side wall panels.

9. The display pack of claim 8, wherein the display pack is configured so that an internal space of the display pack is accessible from outside of the display pack when the removable upper section is removed.

10. The display pack of claim 1, further comprising a glue tab adjoining a bottom edge of the outer front panel and secured to the bottom panel.

11. The display pack of claim 1, wherein the outer front panel is secured to the inner front panel by adhesive, and each of the pair of outer side wall panels is secured to one of said inner side wall panels by adhesive.

12. The display pack of claim 1 wherein said display pack is configured to be assembled from a joined in-the-flat blank unit in which said first and second unitary sheets of material are adhered to one another.

13. The display pack of claim 1 wherein said removable section includes at least portions of said inner front panel, outer front panel and top panel.

14. A joined in-the-flat blank unit for producing a display pack having a display section and a removable section, the joined blank unit comprising:

a first blank having multiple panels separated from one another at fold lines, comprising:

a bottom panel;

first and second inner side wall panels adjoining opposing side edges of the bottom section;

a rear panel adjoining a third side edge of the bottom panel;

third and a fourth inner side wall panels adjoining opposing side edges of the rear panel;

a top panel adjoining an edge of the rear panel opposite said bottom panel; and an inner front panel adjoining an edge of the top panel opposite said rear panel; and a second blank having multiple panels separated from one another at fold lines comprising:

an outer front panel, the outer front panel having a first portion and a second portion separable from one another along a separation line; and a first outer side wall panel and a second outer side wall panel adjoining opposing first and second side edges of the outer front panel, wherein at least one of said first and second outer side wall panels has a first portion and a second portion separable from one another along a second separation line; and wherein said outer front panel of said second blank is secured to the inner front panel of said first blank.

15. The joined in-the-flat blank unit of claim 14, wherein the first blank comprises fifth and sixth inner side wall panels adjoining opposing side edges of the top section.

16. The joined in-the-flat blank unit of claim 14, wherein the second blank further comprises a glue tab adjoining a third edge of the outer front panel.

17. The joined in-the-flat blank unit of claim 14, wherein a width between the fold lines separating said third and fourth side wall panels from said rear panel is greater than the width between the fold lines separating said first and second side wall panels from said bottom panel so that the third and fourth side wall panels will be disposed on the outer side of the first and second side wall panels when the display pack is assembled.

18. A display section of a display pack, comprising:

a bottom panel for forming at least a portion of a display section bottom;

at least one pair of inner side wall panels for forming at least portions of side walls of the display section, said at least one pair of inner side wall panels disposed on opposite sides of said display section;

a back panel forming at least a portion of a display section back wall, wherein said bottom panel, said at least one pair of side wall panels, and said back panel are formed as an integral unit from a first unitary sheet of material;

a front panel forming at least a portion of a display section front wall and defining at least an edge of a display opening; and a pair of outer side wall panels for forming at least a portion of the display section side walls, each outer side wall panel of said pair of outer side wall panels being integrally attached to and extending from opposite side edges of the front panel to form outer side walls, each of the outer side wall panels being adhered to an outer face of a respective one inner side wall panel of said at least one pair of inner side wall panels, wherein said front panel and said pair of outer side wall panels are formed as an integral unit from a second unitary sheet of material.

19. The display section of claim 18 wherein said display pack is configured to be assembled from a joined in-the-flat blank unit in which said first and second unitary sheets of material are adhered to one another.

20. The display section of claim 18 wherein said at least one pair of inner side wall panels comprises first and second pairs of inner side wall panels, said first pair of inner side wall panels being extending from opposing side edges of said bottom panel, and said second pair of inner side wall panels extending from opposing side edges of said back panel, said first and second pairs of inner side wall panels and said pair of outer side wall panels forming said side walls of said display section.

21. The display section of claim 20, wherein the first pair of inner side wall panels have a top height less than a top height of the second pair of inner side wall panels.

22. The display section of claim 18 further comprising a glue tab extending from a lower edge of the front panel and which is adhered to an outer face of the bottom panel.

23. A display pack separable into a display section and a removable upper section, comprising:

a bottom panel;

a rear panel adjoining a back edge of the bottom panel;

a first inner pair of inner side wall panels adjoining opposing side edges of said bottom panel;

a second inner pair of inner side wall panels adjoining opposing side edges of said rear panel;

a top panel adjoining a top edge of the rear panel;

an inner front panel adjoining a forward edge of said top panel;

an outer front panel adhered to the inner front panel, and a pair of outer side wall panels adjoining opposing side edges of the outer front panel, each of said outer side wall panels being secured to an outer face of a respective one of said second inner pair of inner side wall panels.

24. The display pack of claim 23 wherein said bottom panel, said first inner pair of inner side wall panels, said second inner pair of inner side wall panels, said rear panel, said top panel and said inner front panel are formed as an integral unit from a first unitary sheet of material.

25. The display pack of claim 24 wherein said outer front panel and said pair of outer side wall panels are formed as an integral unit from a second unitary sheet of material.

* * * * *